US008777675B2

(12) United States Patent
Chiu

(10) Patent No.: US 8,777,675 B2
(45) Date of Patent: Jul. 15, 2014

(54) VERTICAL CONTACT FOR SHIELDED SOCKETS

(71) Applicant: Chia-Pin Chiu, Tempe, AZ (US)

(72) Inventor: Chia-Pin Chiu, Tempe, AZ (US)

(73) Assignee: Intel Corporation, Santa Clara, CA (US)

( * ) Notice: Subject to any disclaimer, the term of this patent is extended or adjusted under 35 U.S.C. 154(b) by 58 days.

(21) Appl. No.: 13/627,128

(22) Filed: Sep. 26, 2012

(65) Prior Publication Data

US 2014/0087590 A1 Mar. 27, 2014

(51) Int. Cl.
*H01R 13/24* (2006.01)

(52) U.S. Cl.
USPC ..... 439/700; 439/66; 439/824

(58) Field of Classification Search
USPC ..... 439/66, 700, 824
See application file for complete search history.

(56) References Cited

U.S. PATENT DOCUMENTS

| | | | | | |
|---|---|---|---|---|---|
| 3,378,810 | A * | 4/1968 | Dorrell | 439/436 |
| 3,458,851 | A * | 7/1969 | Stella | 439/436 |
| 5,009,613 | A * | 4/1991 | Langgard et al. | 439/482 |
| 5,032,787 | A * | 7/1991 | Johnston et al. | 324/755.05 |
| 5,045,780 | A * | 9/1991 | Swart | 324/754.11 |
| 5,227,718 | A * | 7/1993 | Stowers et al. | 324/755.05 |
| 5,391,995 | A * | 2/1995 | Johnston et al. | 324/755.05 |
| 5,420,519 | A * | 5/1995 | Stowers et al. | 324/754.14 |
| 5,456,621 | A * | 10/1995 | Gan | 439/700 |
| 5,936,421 | A * | 8/1999 | Stowers et al. | 324/750.27 |
| 5,942,906 | A * | 8/1999 | Stowers et al. | 324/750.25 |
| 7,102,369 | B2 * | 9/2006 | Jung | 324/754.14 |
| 7,114,996 | B2 * | 10/2006 | Goodman et al. | 439/700 |
| 7,841,866 | B2 * | 11/2010 | Hsu et al. | 439/66 |
| 8,382,488 | B2 * | 2/2013 | Uesaka | 439/66 |
| 2004/0121627 | A1 * | 6/2004 | Grube et al. | 439/66 |
| 2009/0203235 | A1 * | 8/2009 | Liu et al. | 439/66 |

* cited by examiner

*Primary Examiner* — Ross Gushi
(74) *Attorney, Agent, or Firm* — Blakely, Sokoloff, Taylor & Zafman LLP

(57) ABSTRACT

A conductive contact includes a hollow cylinder, a spring strip and a contact head.

24 Claims, 7 Drawing Sheets

VERTICAL CONTACT FOR SHIELDED SOCKETS

FIELD OF THE INVENTION

The present disclosure generally relates to a shielded socket for an electrical device, and more particularly, to conductive contacts for insertion into a shielded socket.

BACKGROUND

The ongoing trend toward increased performance and higher density electrical circuits has led to the development of surface mount technology in the design of electronic packages and printed circuit boards (PCBs). As the amount of memory increases in electronic systems so does the amount of bandwidth required for the processors, and resultantly the number of in/out (I/O) connections.

Sockets are commonly used to enable multiple insertions of packages onto PCBs (e.g., mother boards) or other substrates to provide mechanical and electrical connections. Shielded sockets electrically isolate an array of conductive contacts from the housing that surrounds the conductive contacts, thus reducing the number of ground pins that are necessary.

The reduction in ground pins, and subsequent reduced pin count, causes a decrease in socket loading force, resulting in a reduced requirement for socket stiffness. Accordingly, current contact designs (e.g., clip and spring designs) do not provide sufficient normal force or electrical resistance for shielded socket designs.

DETAILED DESCRIPTION

In the following description, numerous specific details are set forth in order to provide a thorough understanding of various embodiments. However, various embodiments of the invention may be practiced without the specific details. In other instances, well-known methods, procedures, components, and circuits have not been described in detail so as not to obscure the particular embodiments of the invention.

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment.

Figure 1:
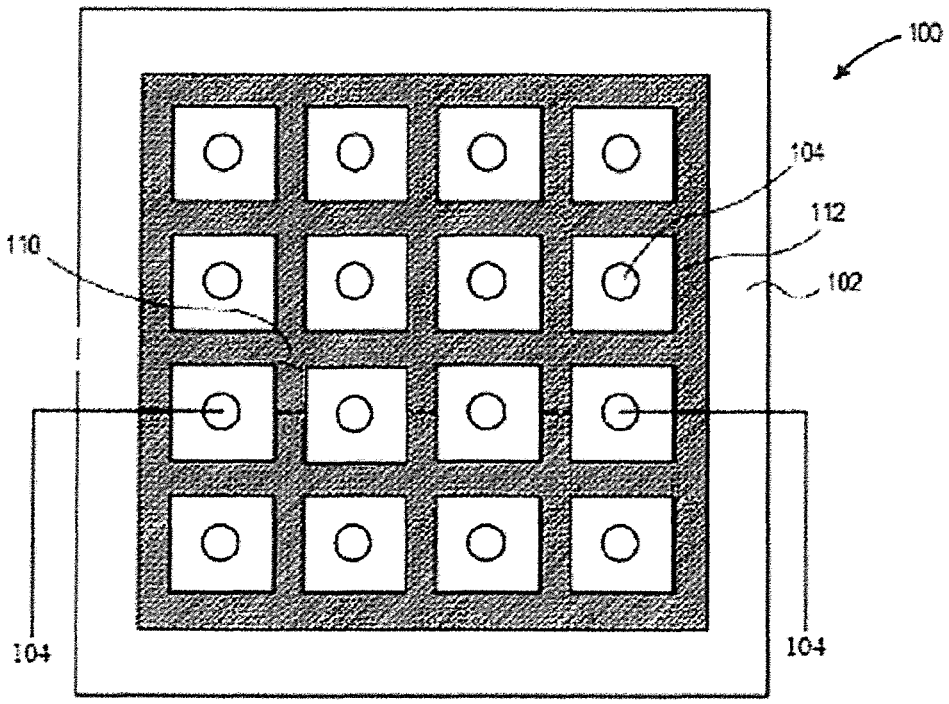
FIG. 1 illustrates one embodiment of a socket.
Figure 7:
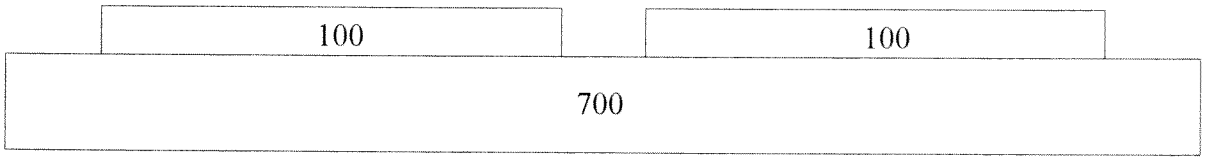
FIG. 7 illustrates one embodiment of a printed circuit board.

FIG. 7 illustrates one embodiment of a printed circuit board 700 including sockets 100. FIG. 1 illustrates one embodiment of a socket 100. Socket 100 includes an insulative housing 102 and an array of contact openings 104 within and surrounded by an insulative housing 102. The array of contact openings 104 extend from a top surface 106 to a bottom surface 108 of the insulative housing 102. A conductive grid 110 is embedded within the insulative housing 102.

Referring to FIG. 1, the conductive grid includes an array of grid openings 112 corresponding to the array of contact openings 104. Each individual grid opening 112 surrounds a respective contact opening 104. In an embodiment, the conductive grid 110 is formed by a series of conductive walls running parallel to the contact openings 104. In an embodiment, the height of the conductive walls is less than the total height of the housing 102 so that the conductive grid 110 is not exposed on the top and bottom surfaces 106, 108 thereby protecting against possible shorting.

It is to be appreciated that while the conductive grid is described and illustrated as being formed of vertical walls and including square grid openings that embodiments of the invention are not limited to such. It is contemplated that other arrangements such as circular, elliptical or polygonal structures may be utilized depending up other geometric and device considerations.

Figure 2:
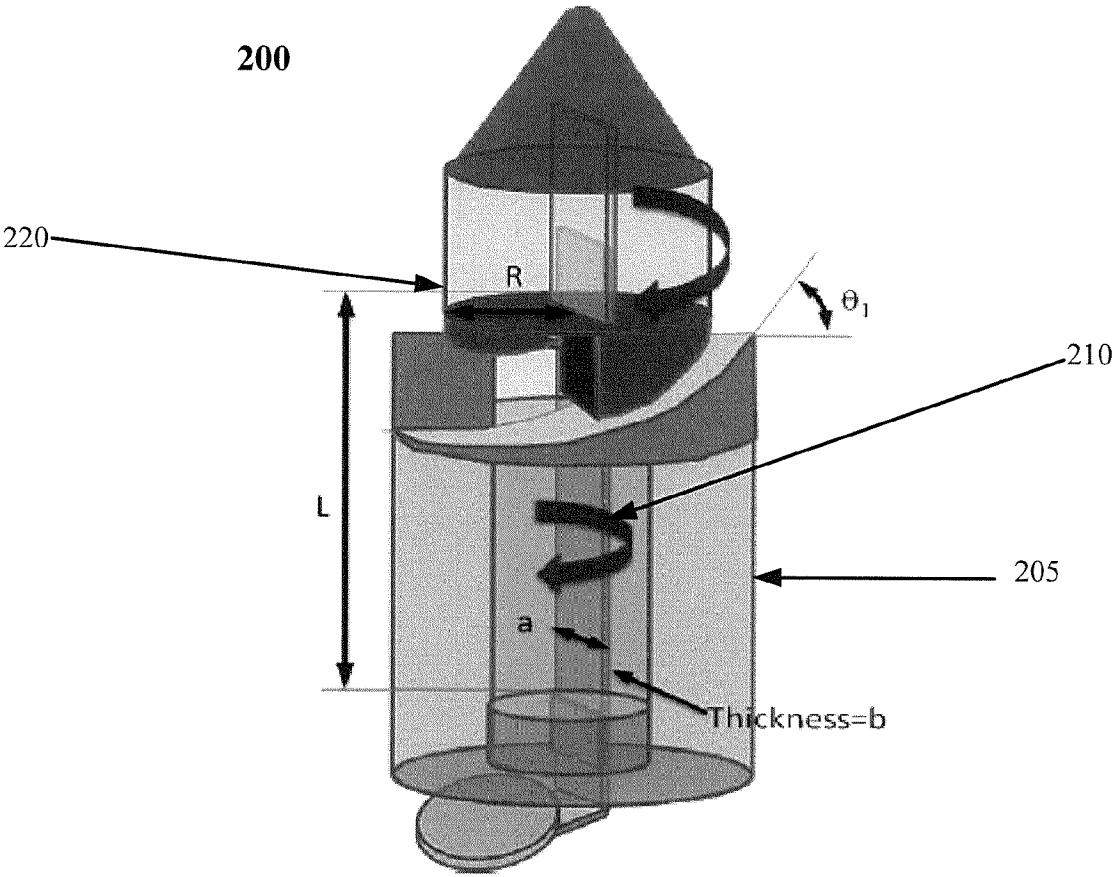
FIG. 2 illustrates one embodiment of a conductive contact.

FIG. 2 illustrates one embodiment of a conductive contact 200 configured to be inserted into any of the array of contact openings 104 within housing 102. According to one embodiment, contact 200 provides a vertical design that applies a torsion force to twist a spring. Contact 200 includes a hollow cylinder 205, a spring strip 210 and contact head 220.

Figure 3:
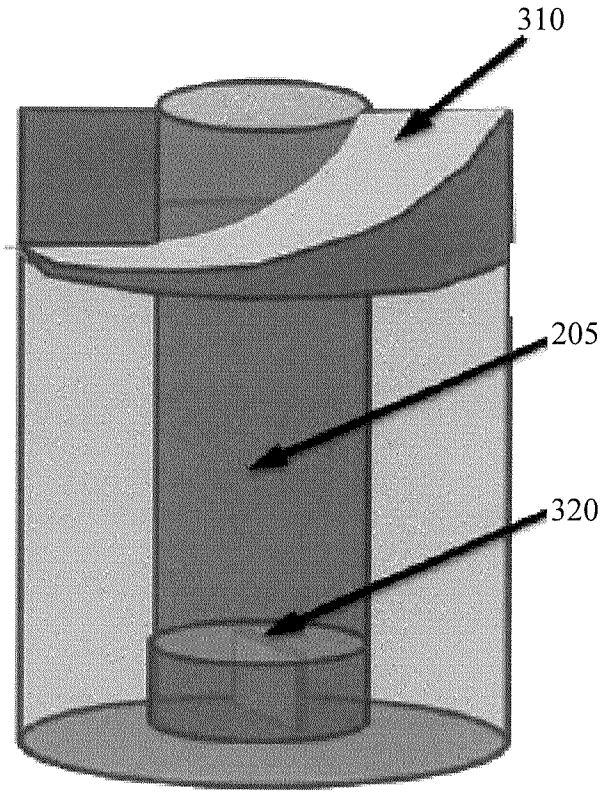
FIG. 3 illustrates one embodiment of a hollow cylinder component of a conductive contact.

FIG. 3 illustrates one embodiment of a hollow cylinder 205. Hollow cylinder 205 includes a slide 310 and a slot 320. Slide 310 converts a rotational motion of contact head 220 into a vertical deflection, while slot 320 holds the bottom portion of spring strip 210 in a fixed position without rotation. According to one embodiment, hollow cylinder 205 is made of traditional socket body material (e.g., Liquid Crystal Polymer (LCP) filled with fiberglass) or electrical insulation whenever conductive contact 200 is implemented as a signal pin. Moreover, in embodiments where conductive contact 200 is implemented as a ground pin, hollow cylinder 205 is made of a metal to enable contact head 220 to a ground grid.

Figures 4A, 4B, 4C:
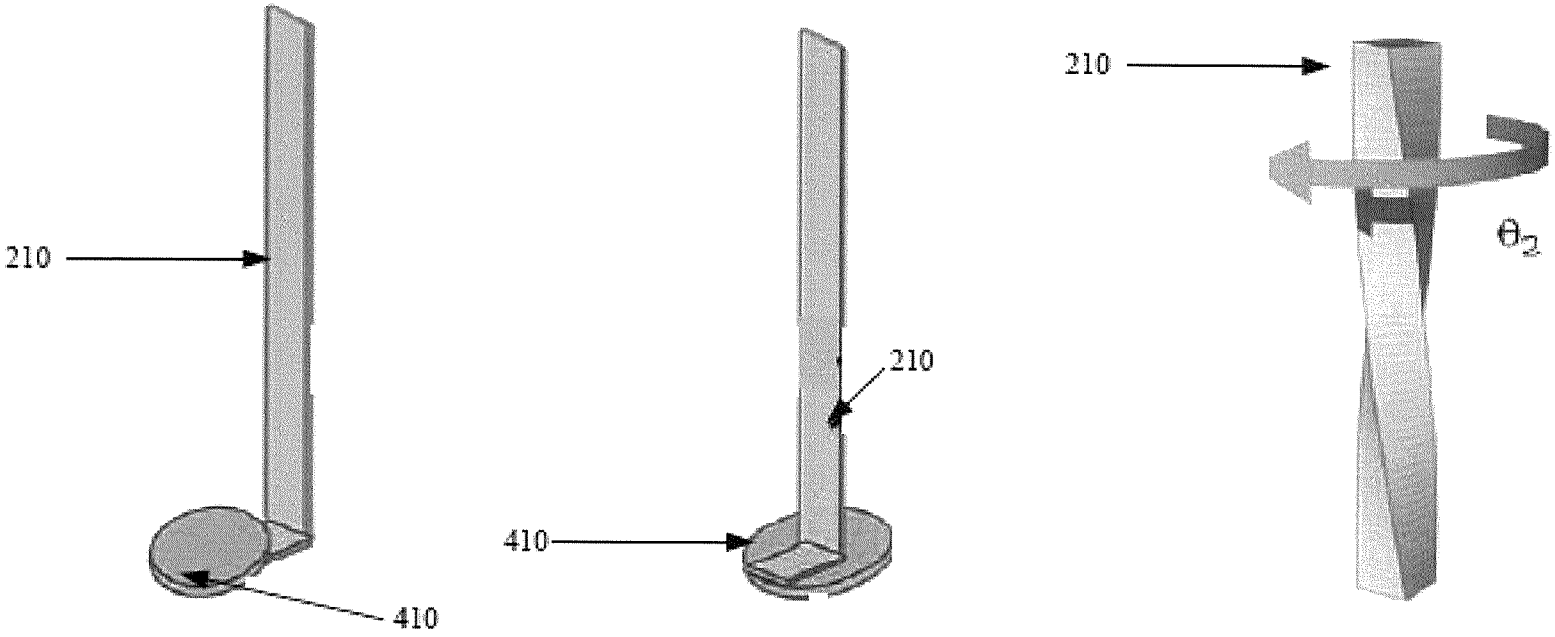
FIGS. 4A-4C illustrate embodiments of a spring strip component of the conductive contact.

FIGS. 4A-4C illustrate embodiments of a spring strip 210. According to one embodiment, spring strip 210 is comprised of a metal with good electrical conduction and an appropriate shear modulus. FIG. 4A illustrates an embodiment in which spring strip 210 includes a pad 410 that is attached with a solder ball to couple spring strip 210 to a printed circuit board (PCB). Similarly, FIG. 4B illustrates another embodiment in which spring strip 210 is attached with a solder ball on the pad 410. FIG. 4C illustrates how spring strip 210 may be twisted by an angle of $\theta_2$ upon a rotation of contact head 220.

Figure 5:
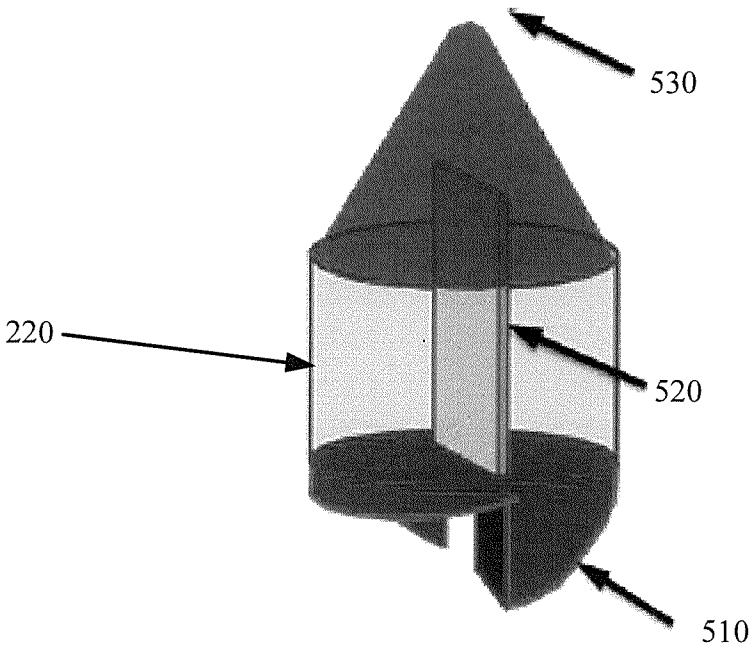
FIG. 5 illustrates one embodiment of a contact head component of a conductive contact.

FIG. 5 illustrates one embodiment of contact head 220. Contact head 220 includes a surface 510 that matches slide 310 of hollow cylinder 205. Surface 510 enables the rotational motion of contact head to be accompanied with a vertical deflection. Contact head 220 also includes a slot 520 that holds the top portion of spring strip 210 so that a torsion force applied from spring strip 210 is translated to contact head 220.

Additionally, a tip 530 of contact head 220 provides a contact to socket 100. Referring back to FIG. 2, the loading of contact 200 into socket 100 causes slide 310 to create a rotation motion of contact head 220, which results in the twisting of spring strip 210 shown in FIG. 4C. As a result, the torsion force from the twisted spring strip 210 provides a normal contact force to the contact head 220.

The above-described conductive contact provides a vertical contact design that applies a torsion force to twist a spring, instead of a bending spring as typically relied on for conventional contacts.

Figure 6:
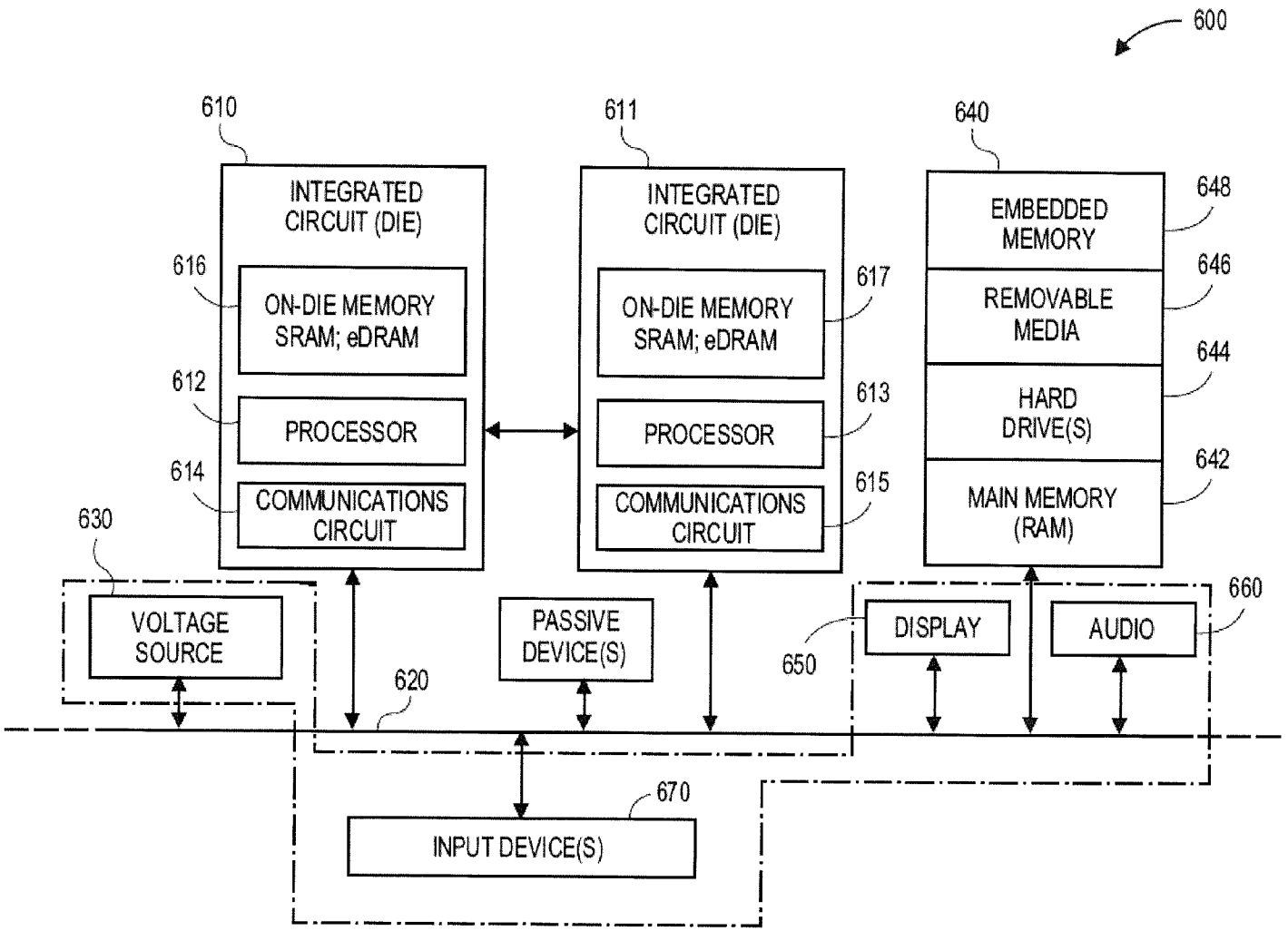
FIG. 6 illustrates one embodiment of a computer system.

FIG. 6 is a schematic of a computer system 600, in accordance with an embodiment of the present invention. The computer system 600 may be a mobile device such as a netbook computer. The computer system 600 may be a mobile device such as a wireless smart phone. The computer system 600 may be a desktop computer. The computer system 600 may be a hand-held reader. The computer system 600 may be a server system. The computer system 600 may be a supercomputer or high-performance computing system.

In an embodiment, the electronic system 600 is a computer system that includes a system bus 620 to electrically couple the various components of the electronic system 600. The system bus 620 is a single bus or any combination of busses according to various embodiments. The electronic system 600 includes a voltage source 630 that provides power to the integrated circuit 610. In some embodiments, the voltage source 630 supplies current to the integrated circuit 610 through the system bus 620.

The integrated circuit 610 is electrically coupled to the system bus 620 and includes any circuit, or combination of circuits according to an embodiment. In an embodiment, the integrated circuit 610 includes a processor 612 that can be of any type. As used herein, the processor 612 may mean any type of circuit such as, but not limited to, a microprocessor, a microcontroller, a graphics processor, a digital signal processor, or another processor. In an embodiment, SRAM embodiments are found in memory caches of the processor. Other types of circuits that can be included in the integrated circuit 610 are a custom circuit or an application-specific integrated circuit (ASIC), such as a communications circuit 614 for use in wireless devices such as cellular telephones, smart phones, pagers, portable computers, two-way radios, and similar electronic systems, or a communications circuit for servers. In an embodiment, the integrated circuit 610 includes on-die memory 616 such as static random-access memory (SRAM). In an embodiment, the integrated circuit 610 includes embedded on-die memory 616 such as embedded dynamic random-access memory (eDRAM).

In an embodiment, the integrated circuit 610 is complemented with a subsequent integrated circuit 611. Useful embodiments include a dual processor 613 and a dual communications circuit 615 and dual on-die memory 617 such as SRAM. In an embodiment, the dual integrated circuit 610 includes embedded on-die memory 617 such as eDRAM.

In an embodiment, the electronic system 600 also includes an external memory 640 that in turn may include one or more memory elements suitable to the particular application, such as a main memory 642 in the form of RAM, one or more hard drives 644, and/or one or more drives that handle removable media 646, such as diskettes, compact disks (CDs), digital variable disks (DVDs), flash memory drives, and other removable media known in the art. The external memory 640 may also be embedded memory 648 such as the first die in an embedded TSV die stack, according to an embodiment.

In an embodiment, the electronic system 600 also includes a display device 650, an audio output 660. In an embodiment, the electronic system 600 includes an input device such as a controller 670 that may be a keyboard, mouse, trackball, game controller, microphone, voice-recognition device, or any other input device that inputs information into the electronic system 600. In an embodiment, an input device 670 is a camera. In an embodiment, an input device 670 is a digital sound recorder. In an embodiment, an input device 670 is a camera and a digital sound recorder.

As shown herein, the integrated circuit 610 can be implemented in a number of different embodiments, including a semiconductor die packaged with one or more ACIs having metal-density layer units of fractal geometry according to any of the several disclosed embodiments and their equivalents, an electronic system, a computer system, one or more methods of fabricating an integrated circuit, and one or more methods of fabricating an electronic assembly that includes a semiconductor die packaged with one or more ACIs having metal-density layer units of fractal geometry according to any of the several disclosed embodiments as set forth herein in the various embodiments and their art-recognized equivalents. The elements, materials, geometries, dimensions, and sequence of operations can all be varied to suit particular I/O coupling requirements including array contact count, array contact configuration for a microelectronic die embedded in a processor mounting substrate according to any of the several disclosed semiconductor die packaged with one or more ACIs having metal-density layer units of fractal geometry embodiments and their equivalents. A foundation substrate may be included, as represented by the dashed line of FIG. 6. Passive devices may also be included, as is also depicted in FIG. 6.

Although embodiments of the invention have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. A conductive contact comprising:

a hollow cylinder including:

a slide to convert a rotational motion of the contact head into a vertical deflection; and a slot to hold a bottom portion of the spring strip in a fixed position without rotation;

a spring strip; and a contact head.

2. The conductive contact of claim 1 wherein the spring strip is comprised of a conductive metal.

3. The conductive contact of claim 2 wherein the spring strip includes a pad to couple the spring strip to a solder ball.

4. The conductive contact of claim 3 wherein the solder ball couples the spring strip to a printed circuit board (PCB).

5. The conductive contact of claim 1 wherein the contact head includes a surface that matches the slide of the hollow cylinder.

6. The conductive contact of claim 5 wherein the surface enables the rotational motion of contact head to be accompanied with the vertical deflection.

7. The conductive contact of claim 5 wherein the contact head further includes a tip to provide a contact to a socket.

8. The conductive contact of claim 5 wherein the contact head includes a slot to hold a top portion of the spring strip to translate a torsion force applied from the spring strip to the contact head.

9. The conductive contact of claim 8 wherein loading the conductive contact into a socket causes the slide to create a rotation motion of the contact head.

10. The conductive contact of claim 9 wherein the rotation motion of the contact head causes a twisting of the spring strip.

11. The conductive contact of claim 10 wherein the twisting of the spring strip provides a normal contact force to the contact head.

12. A socket comprising:

an array of contact openings; and a plurality of conductive contacts mounted within the contact openings, each of the contacts including:

a hollow cylinder including:

a slide to convert a rotational motion of the contact head into a vertical deflection; and a slot to hold a bottom portion of the spring strip in a fixed position without rotation;

a spring strip; and a contact head.

13. The socket of claim 12 wherein the spring strip is comprised of a conductive metal.

14. The socket of claim 13 wherein the spring strip includes a pad to couple the spring strip to a solder ball.

15. The socket of claim 14 wherein the solder ball couples the spring strip to a printed circuit board (PCB).

16. The socket of claim 12 wherein the contact head includes a surface that matches the slide of the hollow cylinder.

17. The socket of claim 16 wherein the surface enables the rotational motion of contact head to be accompanied with the vertical deflection.

18. The socket of claim 16 wherein the contact head includes a slot to hold a top portion of the spring strip to translate a torsion force applied from the spring strip to the contact head.

19. The socket of claim 16 wherein the contact head further includes a tip to provide a contact to a socket.

20. The socket of claim 19 wherein loading the conductive contact into a socket causes the slide to create a rotation motion of the contact head.

21. The socket of claim 20 wherein the rotation motion of the contact head causes a twisting of the spring strip.

22. The socket of claim 21 wherein the twisting of the spring strip provides a normal contact force to the contact head.

23. An apparatus comprising:

a socket including:

an array of contact openings; and a plurality of conductive contacts mounted within the contact openings, each of the contacts including:

a hollow cylinder including:

a slide to convert a rotational motion of the contact head into a vertical deflection; and a slot to hold a bottom portion of the spring strip in a fixed position without rotation;

a spring strip; and a contact head; and a printed circuit board (PCB) coupled to the conductive contacts via the contact head of each of the plurality of conductive contacts.

24. The apparatus of claim 23 wherein the contact head comprises:

a surface that matches the slide of the hollow cylinder to enable the rotational motion of contact head to be accompanied with the vertical deflection;

a slot to hold a top portion of the spring strip to translate a torsion force applied from the spring strip to the contact head; and a tip to provide a contact to a socket.

* * * * *